US007078858B2

(12) United States Patent
Su et al.

(10) Patent No.: US 7,078,858 B2
(45) Date of Patent: Jul. 18, 2006

(54) PLASMA DISPLAY PANEL HAVING NEAR CROSS DISCHARGE SPACES

(75) Inventors: Yao-Ching Su, Taoyuan (TW); Wen-Fa Sung, Hsihchu (TW)

(73) Assignee: Au Optronics Corp., Hsinchu (TW)

( * ) Notice: Subject to any disclaimer, the term of this patent is extended or adjusted under 35 U.S.C. 154(b) by 248 days.

(21) Appl. No.: 10/824,149

(22) Filed: Apr. 14, 2004

(65) Prior Publication Data

US 2005/0093449 A1 May 5, 2005

(30) Foreign Application Priority Data

Oct. 29, 2003 (TW) ..... 92130002 A

(51) Int. Cl.
*H01J 17/49* (2006.01)

(52) U.S. Cl. ..... 313/582; 313/584

(58) Field of Classification Search ..... 313/582–587; 315/169.4; 345/37, 41, 60
See application file for complete search history.

(56) References Cited

FOREIGN PATENT DOCUMENTS

JP 2001-345054 A * 12/2001
JP 2002-049347 2/2002

* cited by examiner

*Primary Examiner*—Joseph Williams
*Assistant Examiner*—Bumsuk Won
(74) *Attorney, Agent, or Firm*—Thomas, Kayden, Horstemeyer & Risley

(57) ABSTRACT

An AC Plasma display panel. In one embodiment of the invention, a plurality of ribs are disposed on a rear substrate forming non-equilateral hexagonal discharge spaces in a delta configuration. A front substrate is disposed opposite the rear substrate. A plurality of bus electrodes substantially extend in a first direction, and each contains a plurality of extending electrodes protruding into corresponding non-equilateral hexagonal discharge spaces.

5 Claims, 13 Drawing Sheets

PLASMA DISPLAY PANEL HAVING NEAR CROSS DISCHARGE SPACES

BACKGROUND OF THE INVENTION

1. Field of the Invention

The present invention relates to an AC plasma display panel and in particular to electrodes and ribs of an AC plasma display panel.

2. Description of the Related Art

A plasma display panel (PDP) is a thin type display, and typically has a large viewing area. The luminescent principle of the PDP is the same as that of fluorescent lamps. A vacuum glass trough is filled with inert gase. When a voltage is applied to the glass trough, plasma is generated and radiates ultraviolet (UV) rays. The fluorescent material coated on the wall of the glass trough adsorbs the UV rays, hence the fluorescent material radiates visible light including red, green and blue light. A plasma display can be described as a combination of hundreds of thousands of illuminating units, each illuminating unit has three subunits for radiating red, green and blue light, respectively. Images are displayed by mixing these three primary colors.

As shown in FIG. 1, a conventional PDP 10 has a pair of glass substrates 12, and 14 arranged parallel and opposite to each other. A discharge space 16 is formed between the glass substrates 12, and 14 and injected with inert gases, such as Ar, Xe or others. The upper glass substrate 12 has a plurality of transverse electrode groups positioned in parallel. Each group of transverse electrodes has a first and a second sustaining electrode 18 and 20, each of which includes transparent electrodes 181 and 201 and bus electrodes 182 and 202. A dielectric layer 24 is further formed covering transverse electrodes, and a protection layer 26 is formed on the dielectric layer 24.

The lower glass substrate 14 has a plurality of barrier ribs 28 arranged in parallel and spaced apart by a predetermined distance dividing the discharge space 16 into a plurality of groups of sub-discharge spaces. Each group of sub-discharge spaces includes a red discharge space 16R, a green discharge space 16G, and a blue discharge space 16B. Additionally, the lower glass substrate 14 has a plurality of lengthwise electrodes 22 disposed in parallel between two adjacent barrier ribs 28 serving as address electrodes. A red fluorescent layer 29R, a green fluorescent layer 29G, and a blue fluorescent layer 29B are respectively coated on the lower glass substrate 14 and the sidewalls of the barrier ribs 28 within each red discharge space 16R, each green discharge space 16G, and each blue discharge space 16B.

When a voltage is applied for driving electrodes, the inert gases in the discharge space 16 are discharged to produce UV rays. The UV rays further illuminate the fluorescent layers 29R, 29G, 29B to radiate visible light including red, green and blue light. After the three primary colors are mixed at different ratios, various images are formed and transmitted through the upper glass substrate 12.

FIG. 2 is a local top view of FIG. 1. Referring to FIG. 2, the ribs 28 are arranged in parallel and spaced apart from each other on the rear substrate. A discharge space 16 is disposed between the first sustain electrode 18 and the second sustain electrode 20. In the discharge space 16, the inert gas is ionized to strike the fluorescent layers on the rear substrate and the ribs 28 to generate light. However, only the fluorescent layers coated on adjacent ribs 28 can generate light, hence luminance of the PDP is not enough. Additionally, drawbacks of the open discharge space are that the adjacent discharge space 162 is prone to crosstalk, causing interference between cells and reducing the PDP 10 display quality.

SUMMARY OF THE INVENTION

Accordingly, an object of the invention is to provide a rib structure arranged in a delta configuration. The rib structure of the present invention forms close discharge spaces with a longer axis in one direction which provides space for longer plasma extension and better discharge efficiency.

To achieve the above objects, the present invention provides a PDP structure comprising the following elements. A plurality of ribs are disposed on a rear substrate, forming non-equilateral hexagonal discharge spaces in a delta configuration. A front substrate is disposed opposite the rear substrate. A plurality of bus electrodes substantially extend in a first direction, and each bus electrode contains a plurality of extending electrodes protruding into a corresponding non-equilateral hexagonal discharge space.

The present invention provides additional PDP structure comprising the following elements. A plurality of ribs are disposed are on a rear substrate, forming diamond shaped discharge spaces in a delta configuration. A front substrate is disposed opposite the rear substrate. A plurality of bus electrodes substantially extend in a first direction and each bus electrode contains a plurality of extending electrodes protruding into corresponding diamond shaped discharge space.

The present invention further provides a PDP structure comprising the following elements. A plurality of ribs are disposed on a rear substrate, forming cross discharge spaces in a delta configuration. A front substrate is disposed opposite the rear substrate. A plurality of bus electrodes substantially extend in a first direction and each bus electrode contains a plurality of extending electrodes protruding into a corresponding cross discharge space.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The present invention provides a rib structure arranged in a delta configuration, wherein the ribs form close discharge spaces. Each discharge space has a first axis along a first direction and a second axis along a second direction. The first axis is longer than the second axis. The first direction and the second direction are perpendicular. A longer plasma extending space and better discharge efficiency are provided, due to the close discharge space containing one longer axis. The non-equal hexagonal, diamond shape, cross, and near cross discharge spaces are respectively disclosed in the following first, second, third and fourth embodiments, wherein each has one longer axis, such that better discharge efficiency is achieved. Furthermore, structures of bus electrodes and extending electrodes are disclosed in detail in each embodiment.

FIRST EMBODIMENT

Figure 1:
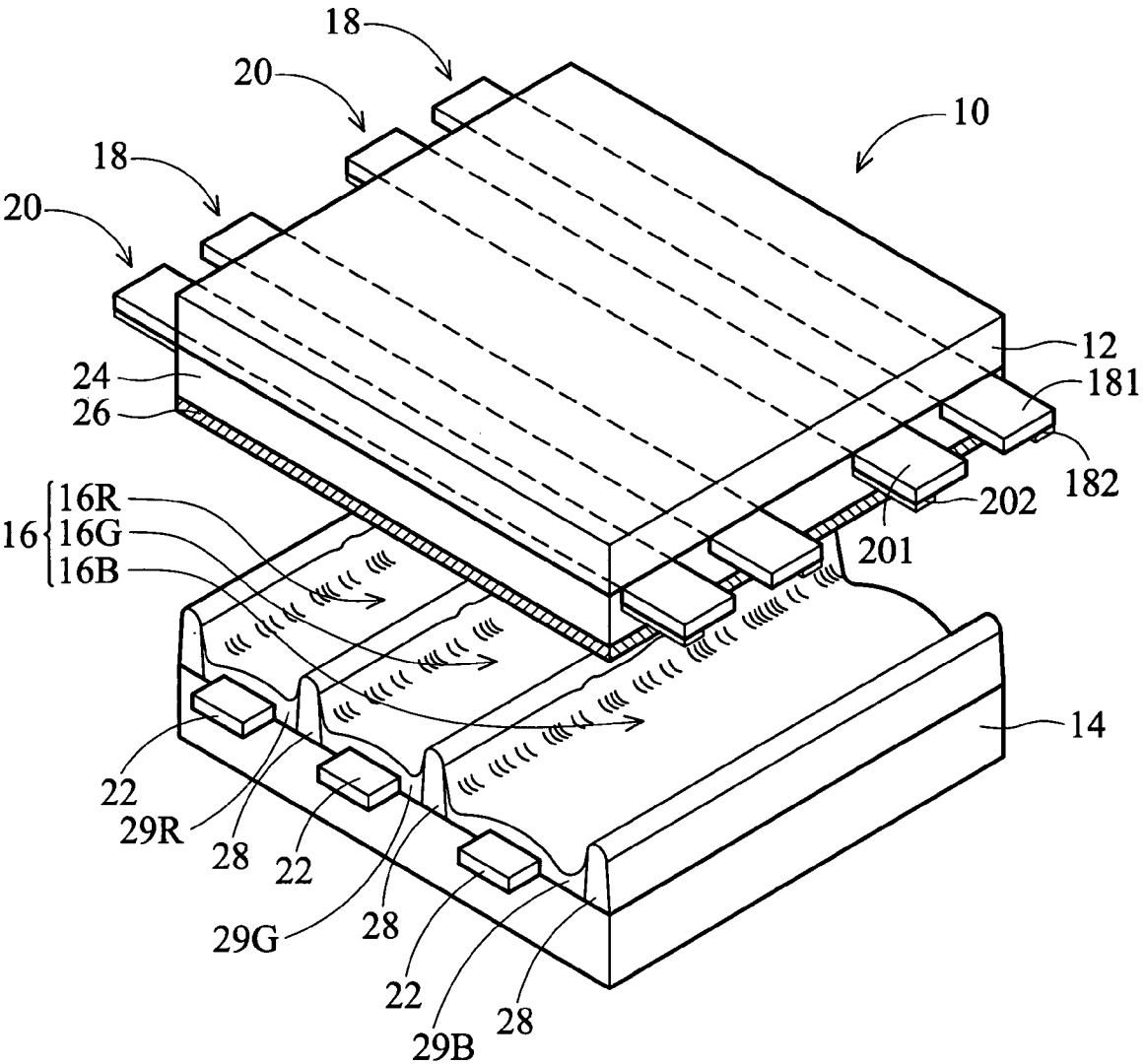
FIG. 1 (RELATED ART)
FIG. 1 shows the structure of the conventional PDP.
Figure 2:
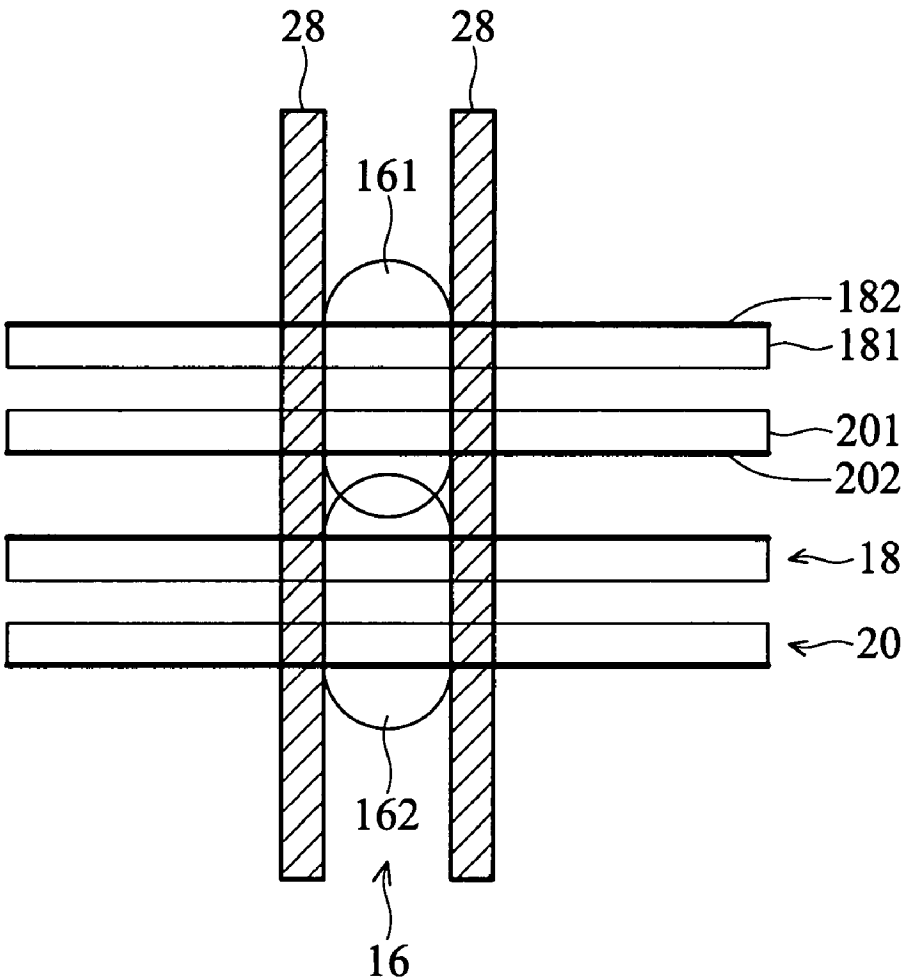
FIG. 2 (RELATED ART)
FIG. 2 is a plane view of the conventional PDP with close discharge spaces.
Figure 3:
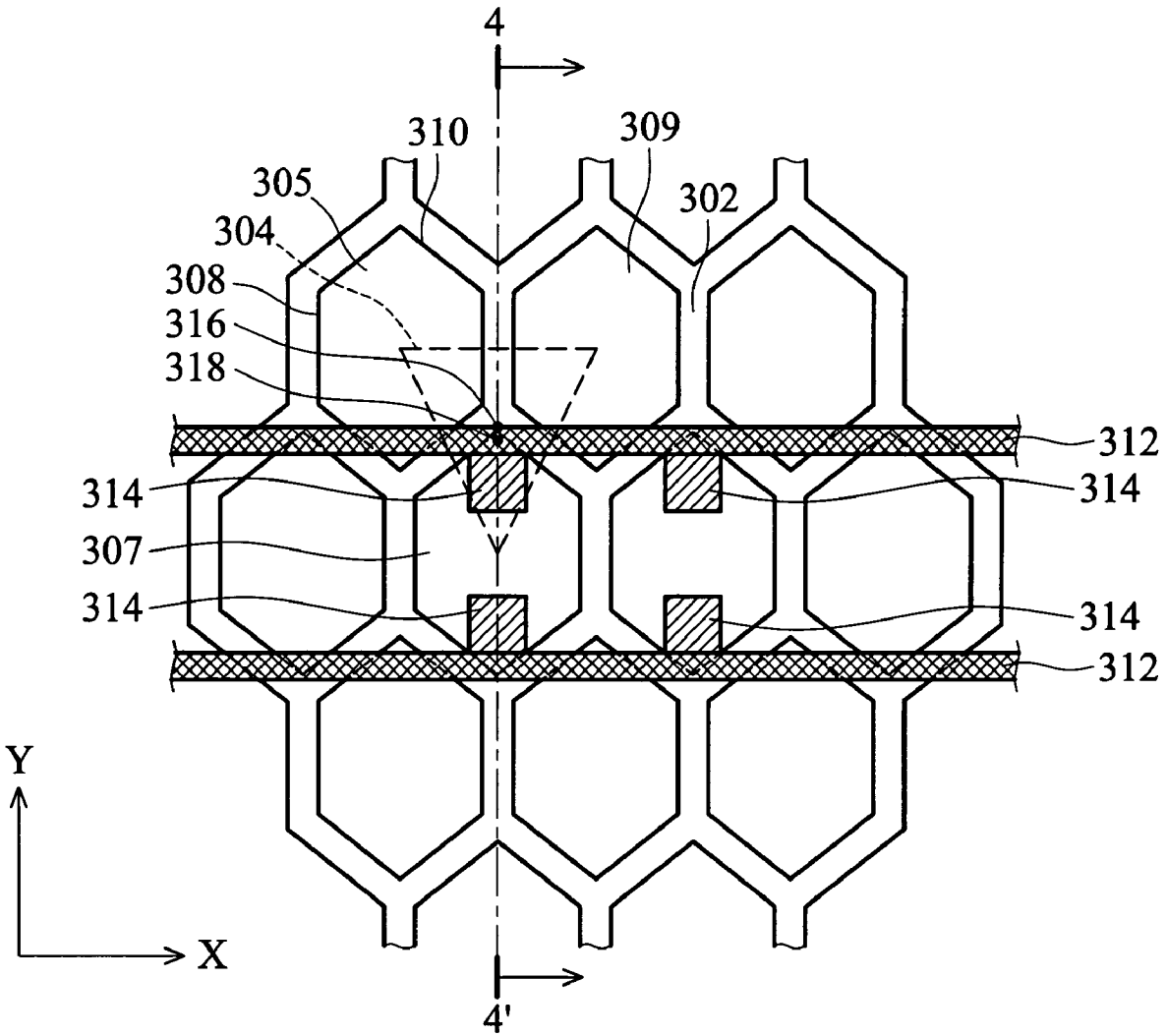
FIG. 3 is a top view of a PDP of the first embodiment.
Figure 4:
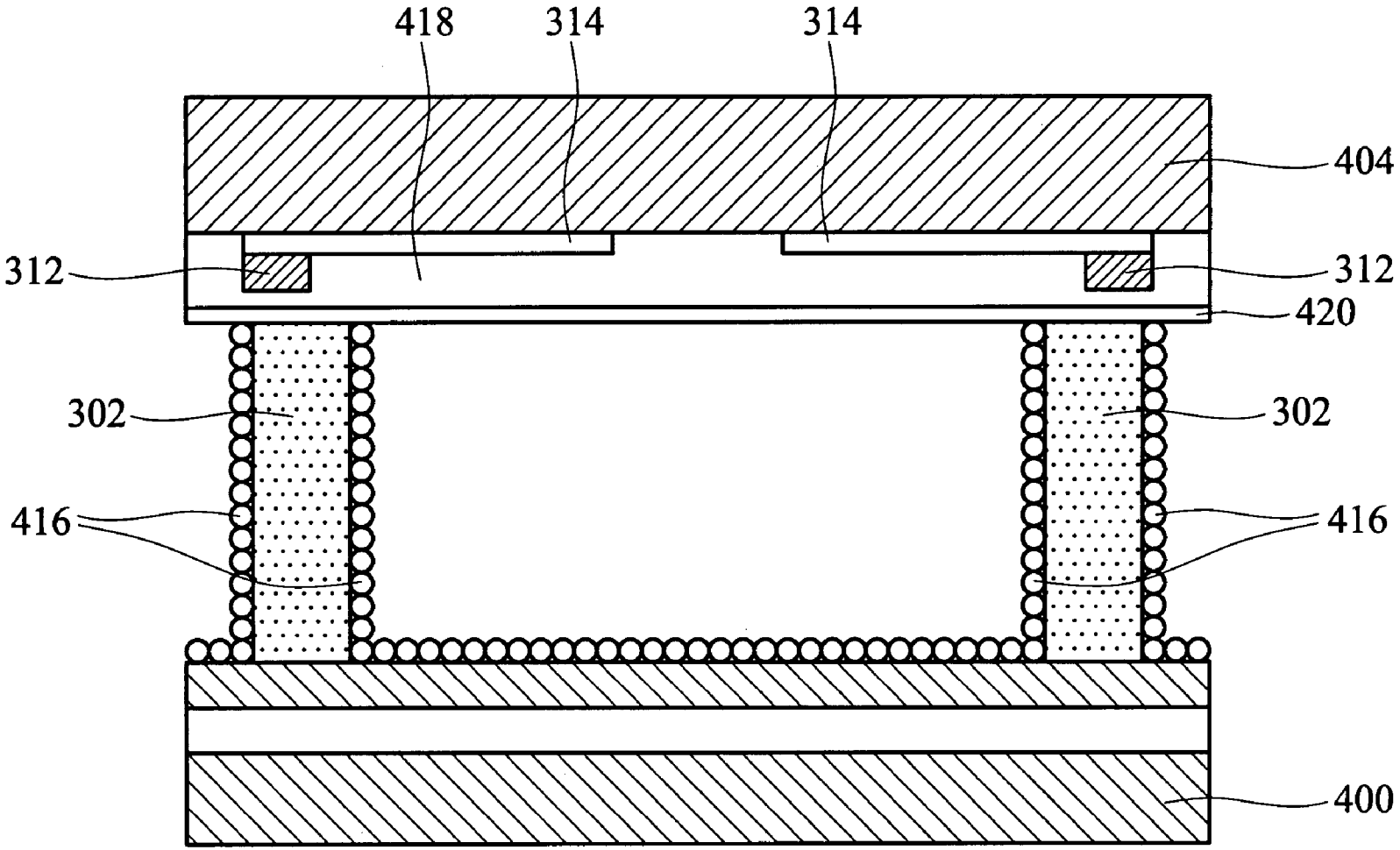
FIG. 4 is cross section along line 4–4' of FIG. 3.

FIG. 3 is a top view of the PDP of the first embodiment and FIG. 4 is a cross section view along the line 4–4' of FIG. 3.

As shown in FIG. 3 and FIG. 4, a plurality of ribs 302 are disposed on a rear substrate 400 and form non-equilateral hexagonal discharge spaces in a delta configuration 304. Consequently, red non-equilateral hexagonal discharge space 305, green non-equilateral hexagonal discharge space 307 and blue non-equilateral hexagonal discharge space 309 are formed in a delta configuration. In the prefered embodiment, each rib 302 has two layers with different color. The top layer of the rib is black to enhance contrast and the bottom layer is white to increase luminance. The preferable height of each rib 308 is 100 μm~180 μm. Preferably, the non-equilateral hexagonal discharge space is symmetrical, and comprises four bevel sides 310, and two parallel vertical sides 308. Each vertical side 308 is preferably ½ the size of the bevel side 310, and more preferably the vertical side 308 is ¼ time of the bevel side 310.

Referring to FIG. 3 and FIG. 4, a front substrate 404 is disposed over a rear substrate 400. A plurality of bus electrodes 312 disposed on the front substrate 404 extend in direction X, passing the top region and the down region of the corresponding non-equilateral hexagonal discharge space. The bus electrodes 312 can be arranged in lines electrodes and parallel to each other. The bus electrodes 312 include a plurality of extending electrodes 314 extending in direction Y to stick out into corresponding non-equilateral hexagonal sub-pixels. The extending electrodes 314 can be rectangular. The bus electrodes 312 can be a multi-layer metal film, such as Cr/Cu/Cr, or Ag. The extending electrodes 314 are preferably formed of transparent conductive material, such as ITO. As shown in FIG. 4, a fluorescent layer 416 is formed on the rib 302. A dielectric layer 418 covers the bus electrode 312 and the extending electrode 314, and a protective layer 420 covers the dielectric layer 418.

Consequently, the non-equilateral hexagonal discharge spaces provided by the invention have longer vertical axis length, and thus provide longer plasma extending distance and increasing better discharge efficiency. Moreover, the close discharge spaces of the invention can eliminate crosstalk.

Figure 5:
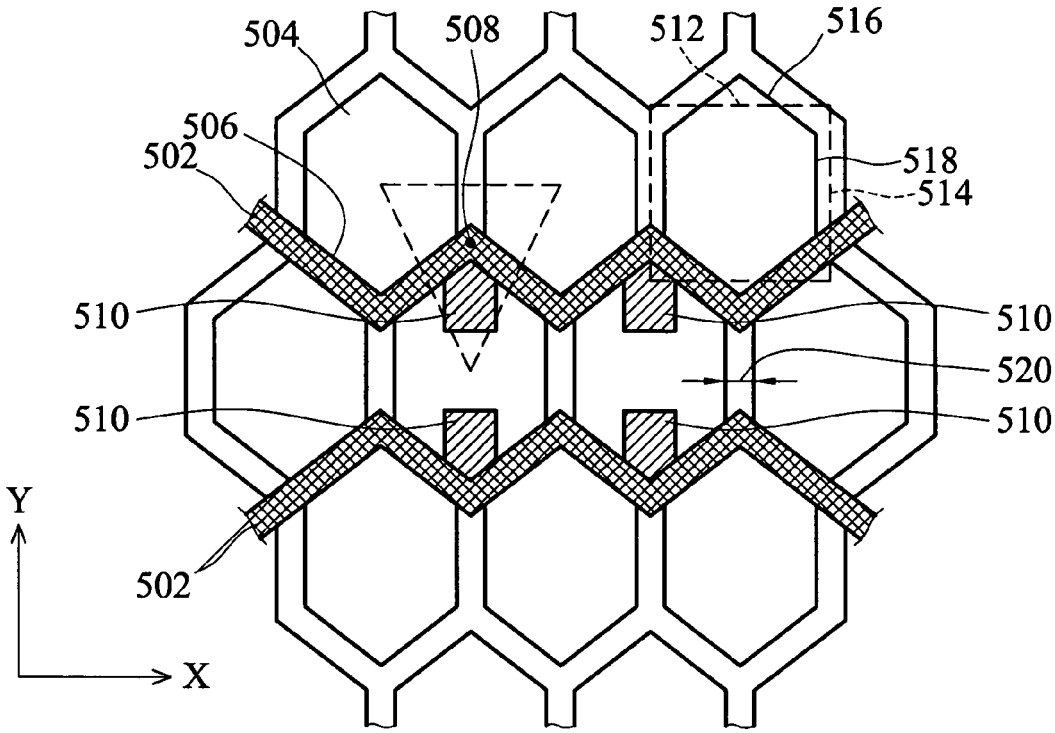
FIG. 5 is a top view of a PDP of another electrode structure of the first embodiment.

Referring to FIG. 5, the bus electrodes 502 can be arranged in a zigzag shape extending along the ribs 506 substantially in direction X. The bus electrode includes a plurality of extending electrodes 510 extending in direction Y. The extending electrodes 510 can be rectangular.

Figure 6:
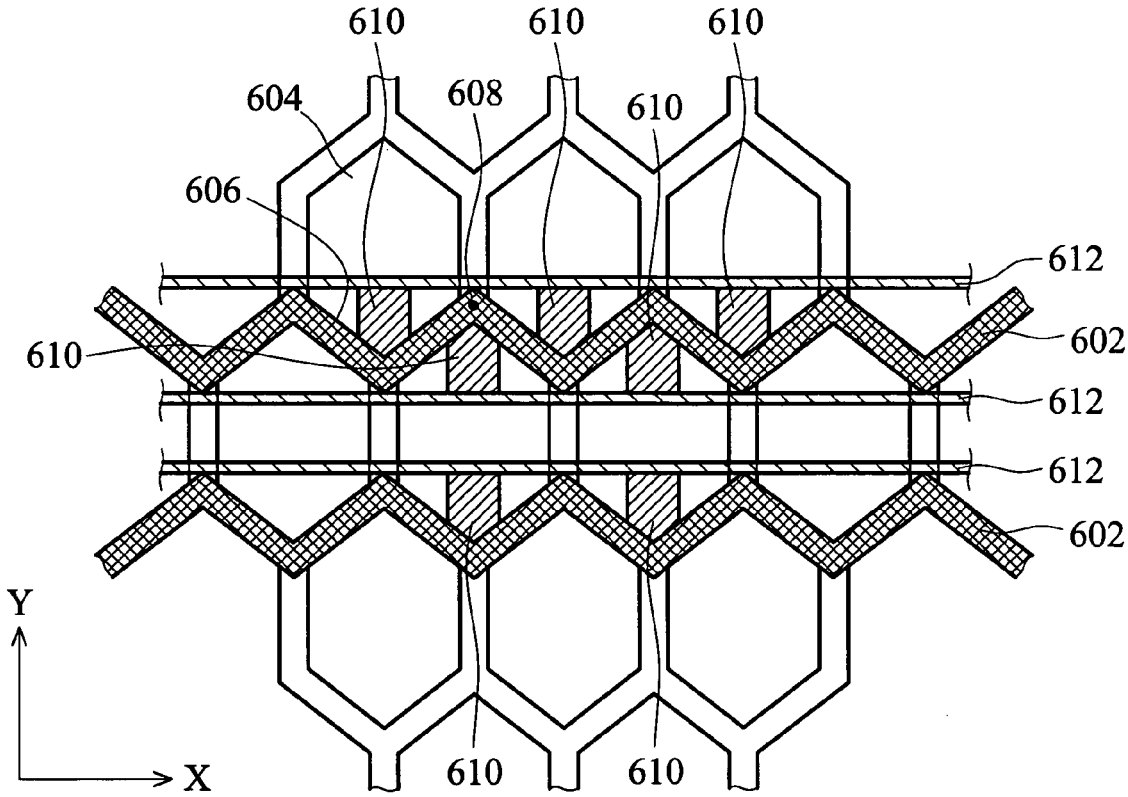
FIG. 6 is a top view of a PDP of further another electrode structure of the first embodiment.

FIG. 6 illustrates an electrode structure of the first embodiment. In FIG. 6, the bus electrodes 602 can be arranged in a zigzag shape extending along the ribs 606 substantially in direction X. The bus electrode includes a plurality of rectanglular extending electrodes 610 extending in direction Y. The extending electrodes 610 are connected in parallel by corresponding connecting electrode 612.

Figure 7:
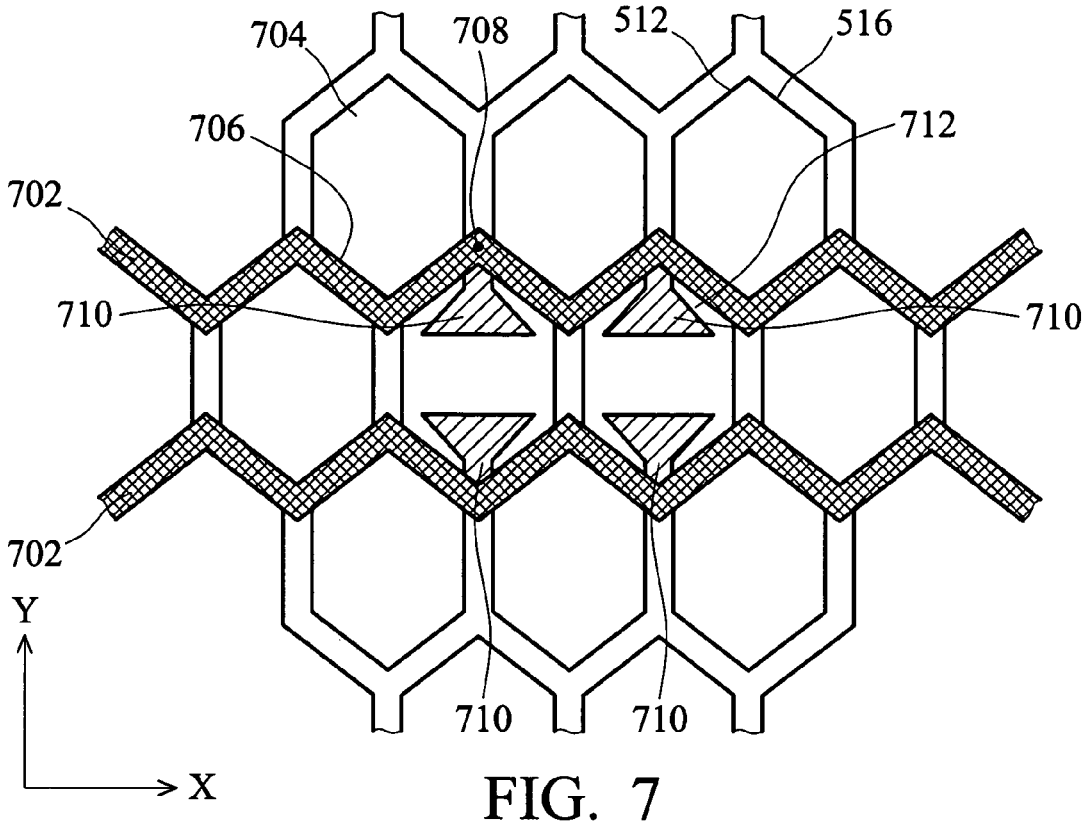
FIG. 7 is a top view of a PDP of yet another electrode structure of the first embodiment.

FIG. 7 illustrates another electrode structure. In FIG. 7, the bus electrodes 702 can be arranged in a zigzag shape extending along the ribs 706 substantially in direction X. The bus electrode 702 includes a plurality of near triangular extending electrodes 710 extending in direction Y. The near triangular extending electrode 710 is preferably spaced apart from the ribs 702 by a distance of between 30 μm to 50 μm to prevent effecting discharge efficiency.

Figure 8:
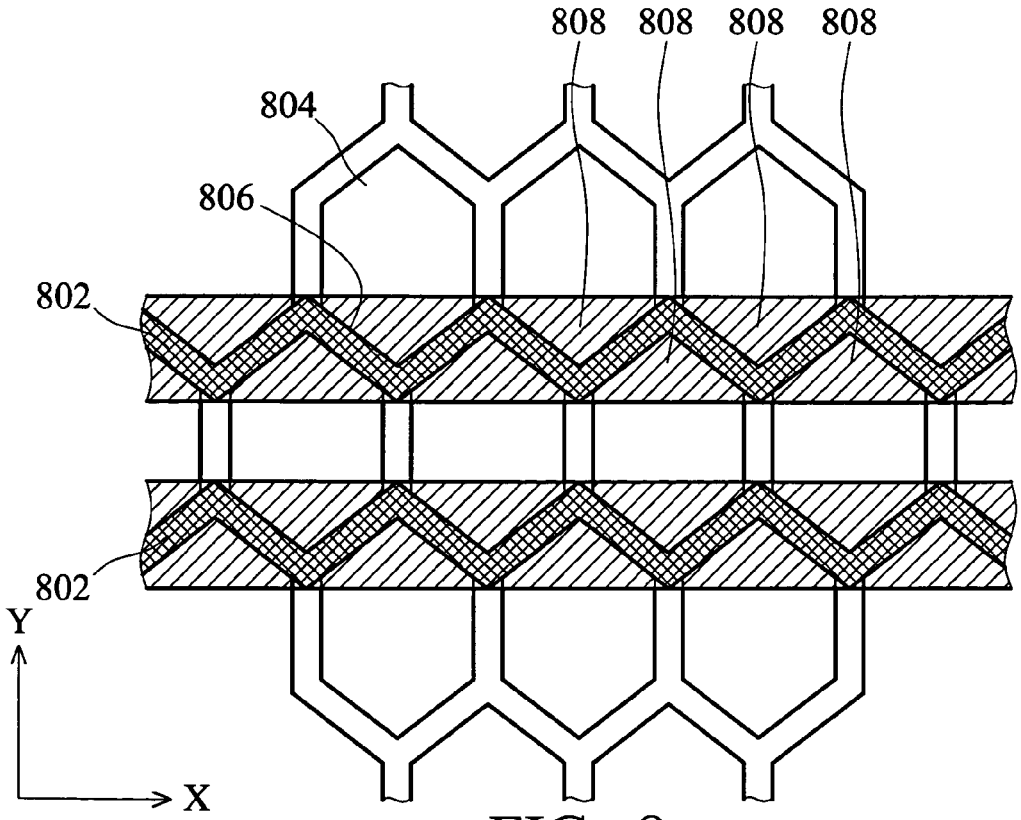
FIG. 8 is a top view of a PDP of yet further another electrode structure of the first embodiment.

FIG. 8 illustrates yet another electrode structure. In FIG. 8, the bus electrodes 802 can be arranged in a zigzag shape extending along the ribs substantially in direction X. The bus electrode 802 includes a plurality of near triangular extending electrodes 808 extending in direction Y. The bus electrodes 802 and the extending electrodes 808 form a bar shaped electrodes extending in direction X.

Figure 9:
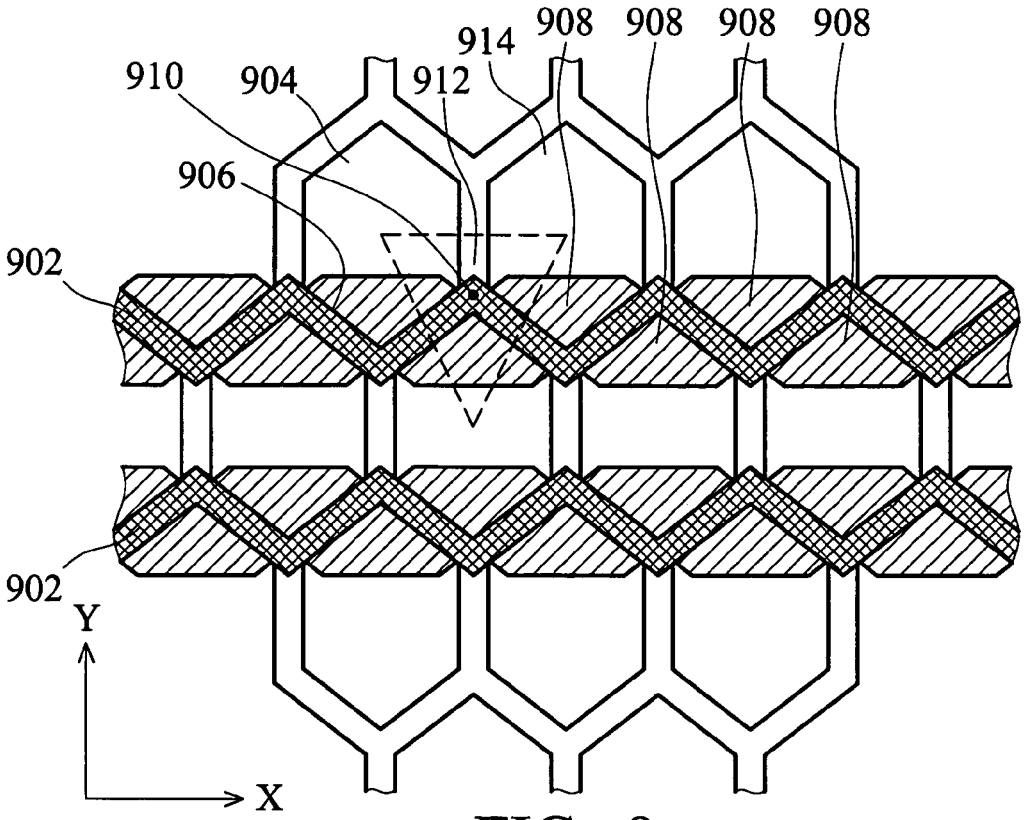
FIG. 9 is a top view of a PDP of another electrode structure of the first embodiment.

FIG. 9 illustrates still another electrode structures. In FIG. 9, the bus electrodes 902 can be arranged in a zigzag shape extending along the ribs 906 substantially in direction X. The bus electrode 902 includes a plurality of near triangular extending electrodes 908 extending in direction Y. The bus electrodes 902 and the extending electrodes 908 form a bar shaped electrodes with openings 912 near the intersection 910 of lines in different directions of the zigzag shape bus electrodes 902. Thus, the bus electrodes with the openings 912 can prevent crosstalk. As well, the bus electrodes of the bar shaped electrodes do not contact adjacent extending electrodes at angled points.

Referring to FIG. 5, the PDP having a resolution 1365*768 is given as an example, the lateral pitch 512 size is about 540 μm and the vertical pitch 514 size is about 405 μm. The length of the bevel side 516 of the non-equilateral hexagon is about 344 μm, and length of the vertical side 518 of the non-equilateral hexagon is about 146 μm. The width of the rib is about 60 μm.

SECOND EMBODIMENT

Figure 10:
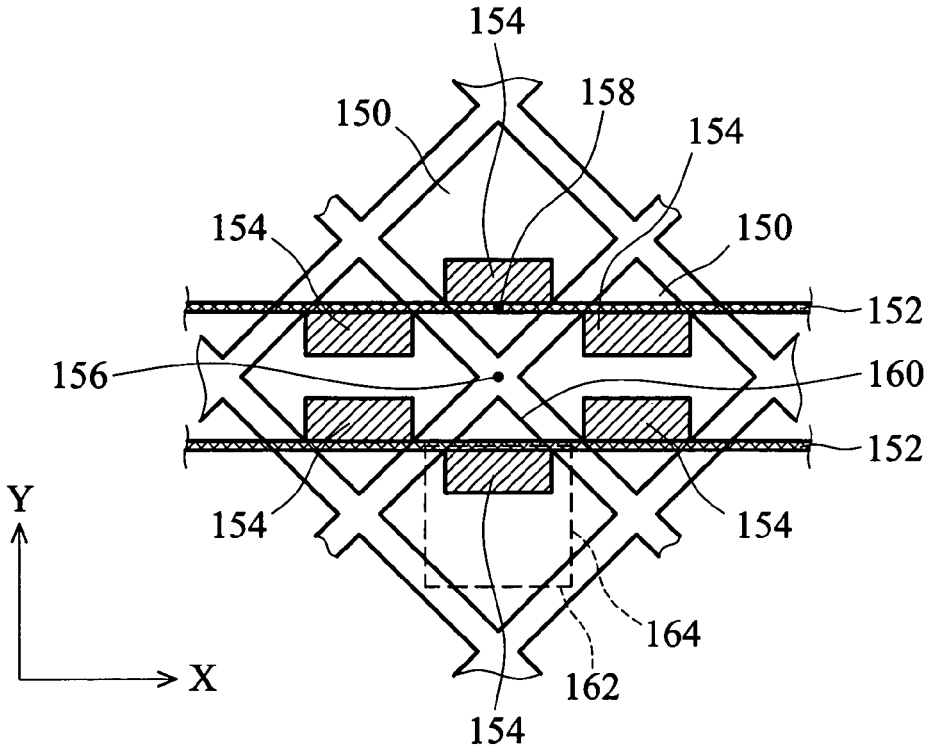
FIG. 10 is a top view of a PDP of the second embodiment.

FIG. 10 is a top view of the PDP of the second embodiment. As shown in FIG. 10, a plurality of ribs are disposed on a rear substrate to form diamond shaped discharge spaces 150 in a delta configuration. Consequently, red non-equilateral hexagonal, green non-equilateral hexagonal and blue non-equilateral hexagonal discharge spaces are formed in a delta configuration. In the preferred embodiment, each rib has two layers with different color. The top layer of the ribs is black to enhance contrast and the bottom layer is white to increase luminance. The preferable height of each rib is 100 μm~180 μm.

A front substrate is disposed over a rear substrate. A plurality of bus electrodes 152 are disposed on the front substrate extending in direction X, passing the top region and the down region of the corresponding diamond shaped discharge space 150. The bus electrodes 152 can be arranged in lines and parallel to each other. Each bus electrode 152 includes a plurality of extending electrodes 154 extending in direction Y to protrude into a corresponding diamond shaped sub-pixel 150. The extending electrodes 154 can be rectangular. The bus electrodes 152 can be a multi-layer metal film, such as Cr/Cu/Cr, or Ag. The extending electrodes 154 are preferably formed of transparent conductive material, such as ITO.

Consequently, the diamond shaped discharge space 150 provided by the invention has a longer vertical axis, such that it can provide longer plasma extending distance, thus increasing discharge efficiency. Moreover, the close discharge space of the invention prevents crosstalk.

Figure 11:
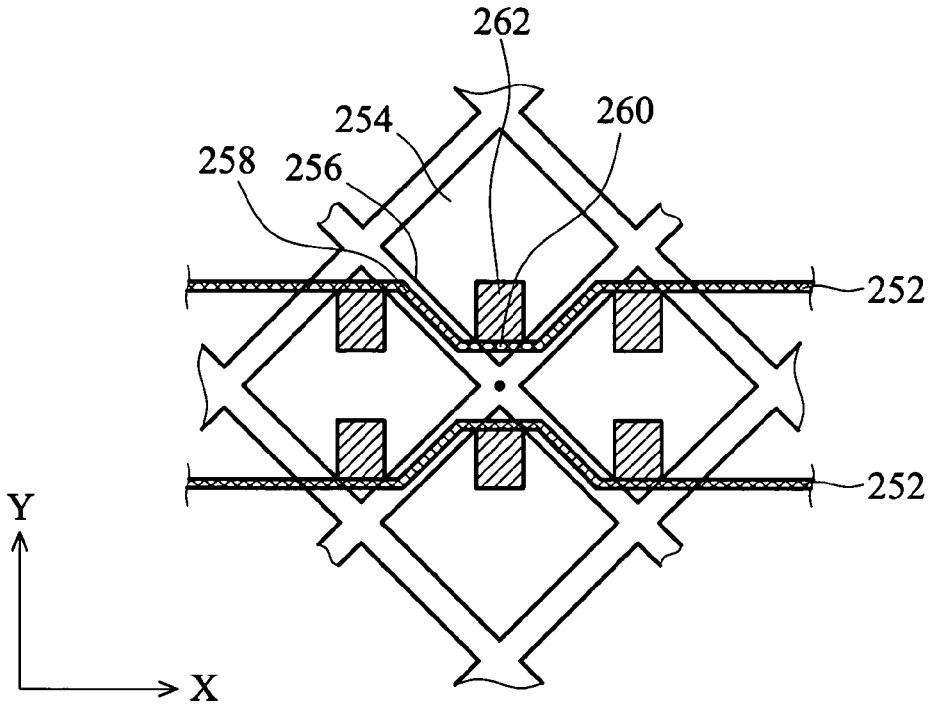
FIG. 11 is a top view of a PDP of another electrode structure of the second embodiment.

FIG. 11 illustrates another electrode structure of the second embodiment. Referring to FIG. 11, the bus electrodes 252 can be arranged in a zigzag shape extending along the ribs substantially in direction X. The bus electrode 252 includes the first lines 258 along the ribs 256 and the second lines 260 along the direction X. The bus electrode 252 further includes a plurality of extending electrodes 262 extending in direction Y. The extending electrodes 262 can be rectanglular, protruding into the diamond shaped discharge space 254.

Figure 12:
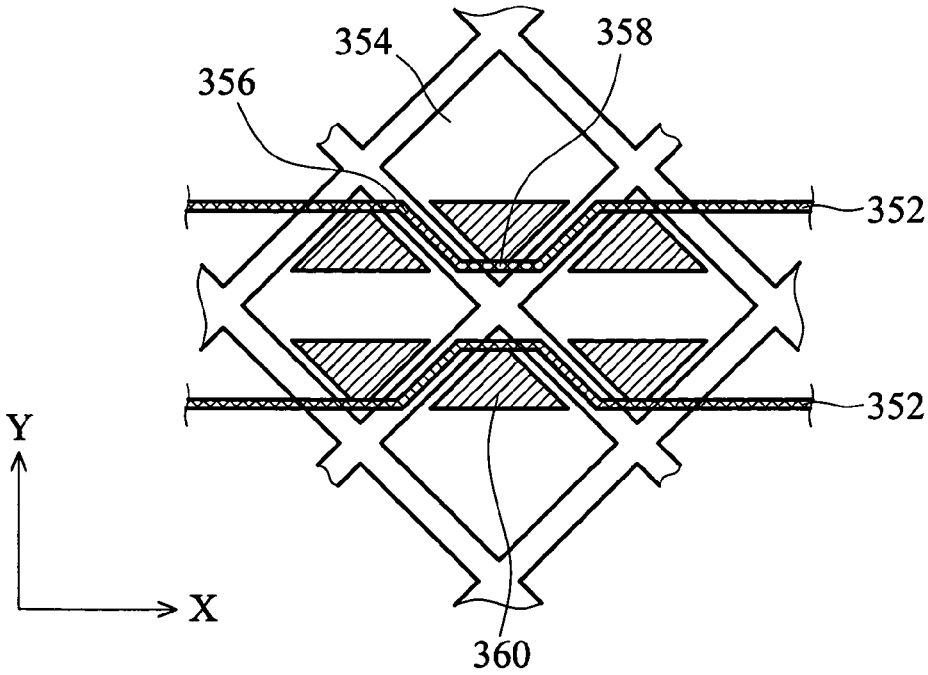
FIG. 12 is a top view of a PDP of further another electrode structure of the second embodiment.

FIG. 12 illustrates yet another electrode structure of the second embodiment. Referring to FIG. 12, the bus electrodes 352 can be arranged in a zigzag shape extending along the ribs substantially in direction X. The bus electrode includes the first lines 356 along the ribs and the second lines 358 along the direction X. The bus electrode further includes a plurality of extending electrodes 360 extending in direction Y. The extending electrodes 360 can be near triangle, protruding into the diamond shaped discharge space 354. The near triangular extending electrode 360 is preferably separated from the ribs by a distance ranging from 30 μm to 50 μm to prevent effecting discharge efficiency.

Figure 13:
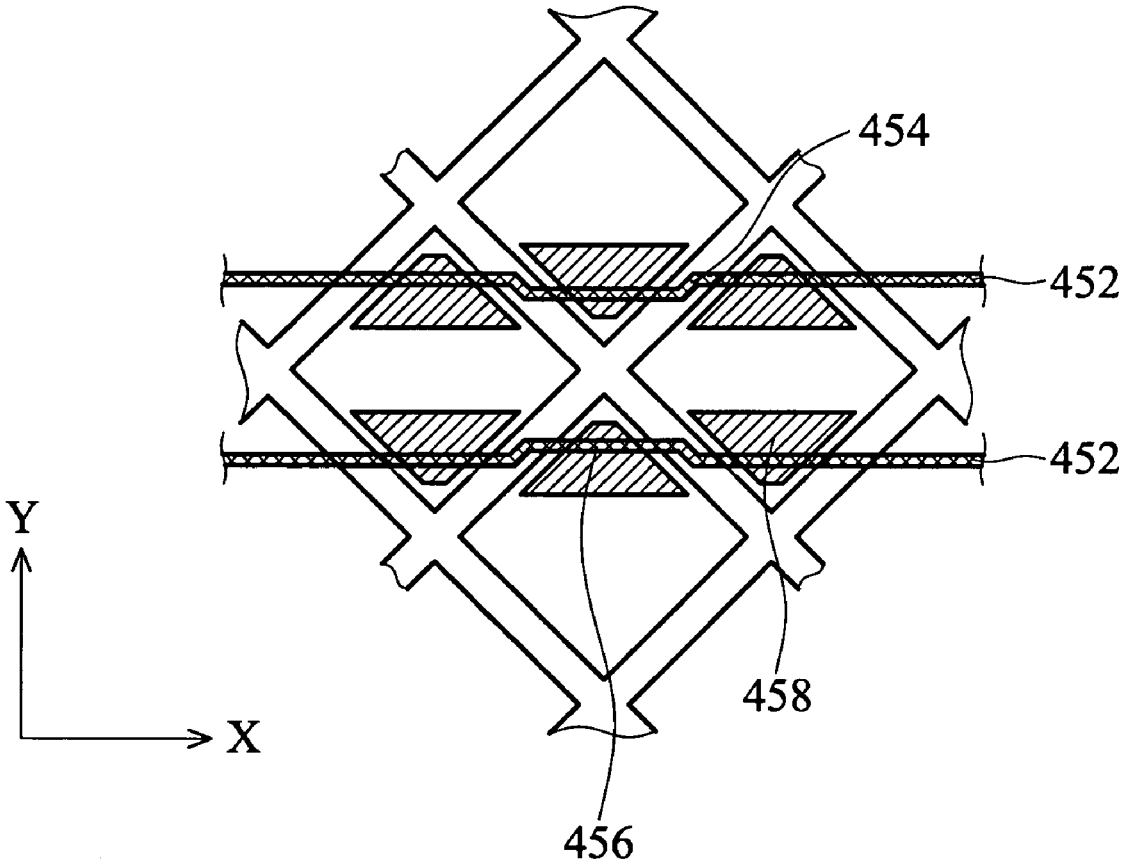
FIG. 13 is a top view of a PDP of yet another electrode structure of the second embodiment.

FIG. 13 illustrates yet another electrode structures. Referring to FIG. 13, the bus electrodes 452 can be arranged in a zigzag shape extending along the ribs substantially in direction X. The bus electrode includes the first lines 454 along the ribs and the second lines 456 along the direction X. The bus electrode 452 further includes a plurality of extending electrodes 458 extending in direction Y. The extending electrodes 458 can be near triangular, protruding into the corresponding diamond shaped discharge space and back intersecting with the second lines. The near triangular extending electrode 458 is preferably spaced apart from the ribs by a distance of between 30 μm to 50 μm to prevent effecting discharge efficiency.

Referring to FIG. 10, the PDP having a resolution 1365*768 is given as an example of the embodiment, the lateral pitch 162 size is about 540 μm and the vertical pitch 164 size is about 164 μm. Length of the bevel side 160 of the diamond is about 337.5 μm. Width of the rib is about 60 μm.

THIRD EMBODIMENT

Figure 14:
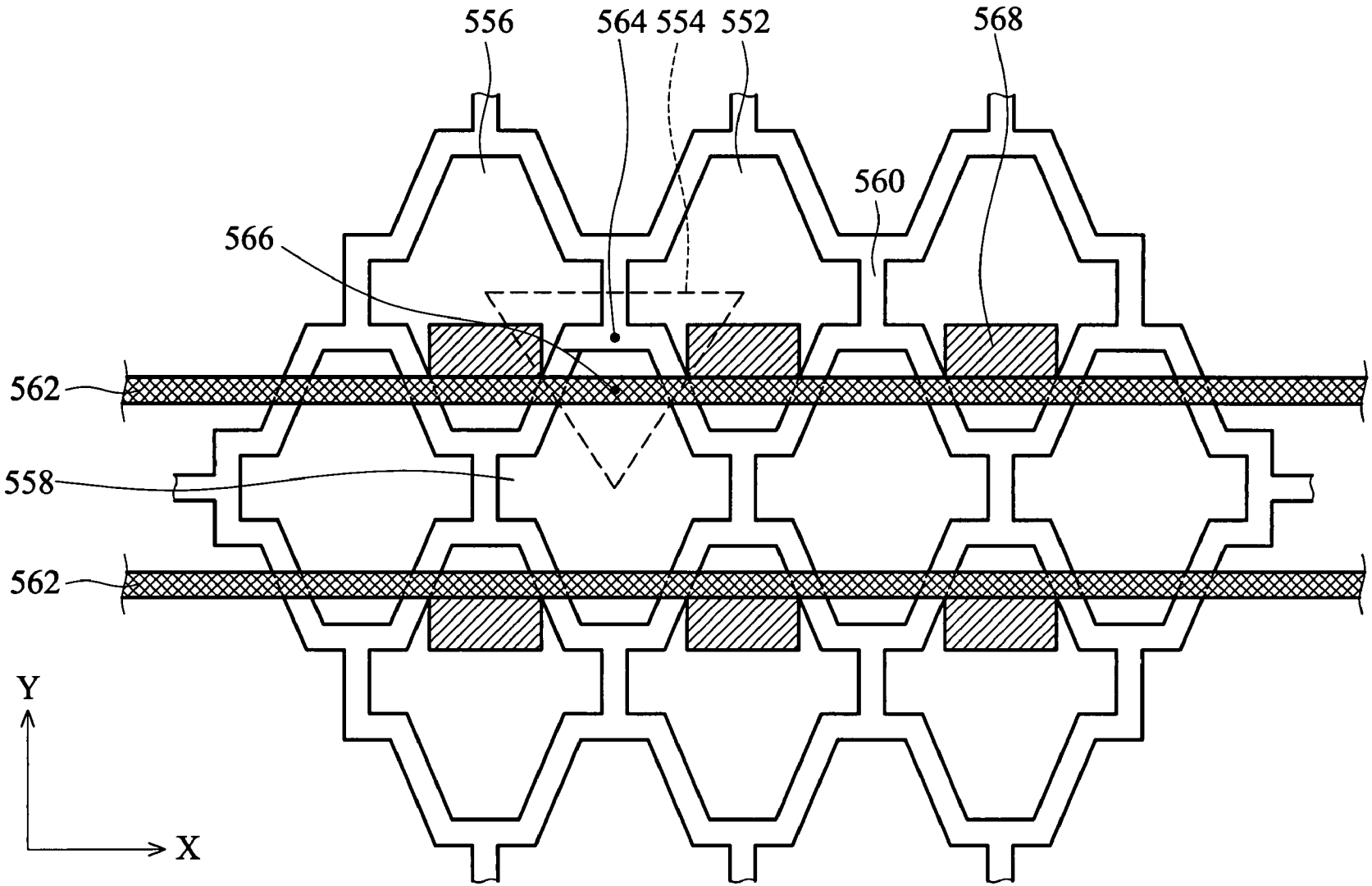
FIG. 14 is a top view of a PDP of the third embodiment.

FIG. 14 is a top view of the PDP of the third embodiment. As shown in FIG. 10, a plurality of ribs 560 are disposed on a rear substrate to form cross discharge spaces 552 in a delta configuration 554. Consequently, red cross discharge space 556, green cross discharge space 558 and blue cross discharge space 560 are formed in a delta configuration 554. In the preferable embodiment, each rib 560 has two layers with different color. The top layer of the rib 560 is black to enhance contrast and the bottom layer is white to increase luminance. The preferable height of each rib 560 is 100 μm~180 μm.

A front substrate is disposed over a rear substrate. A plurality of bus electrodes 562 are disposed on the front substrate, extending in direction X and passing the top region and the down region of the corresponding cross discharge space 558. Each bus electrode 562 can be arranged in a line shape and parallel to each other. The bus electrodes 562 include a plurality of extending electrodes 568 extending in direction Y to protrude into corresponding cross sub-pixel 552. The extending electrodes 568 can be rectangular. The bus electrodes 562 can be a multi-layer metal film, such as Cr/Cu/Cr, or Ag. The extending electrodes 568 are preferably formed of transparent conductive material, such as ITO.

Consequently, the rib structure of the present invention forms close discharge spaces 552 with a longer axis in one direction which provides space for longer plasma extension and better discharge efficiency. The close discharge space of the invention can avoid crosstalk.

Figure 15:
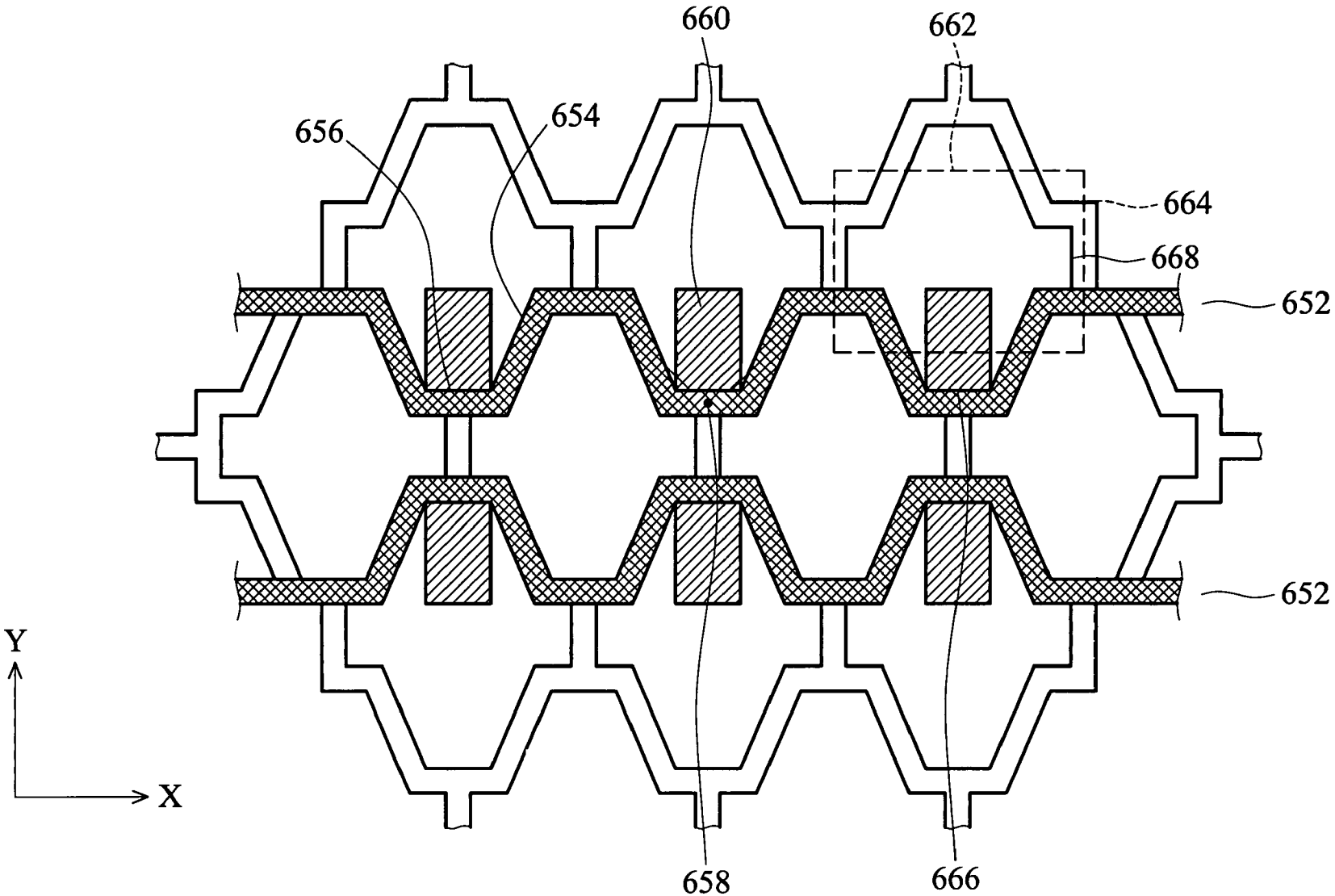
FIG. 15 is a top view of a PDP of another electrode structure in the third embodiment.

FIG. 15 illustrates another electrode structure of the third embodiment. Referring to FIG. 15, the bus electrodes 652 can be arranged in a zigzag shape extending along the ribs substantially in direction X. The bus electrode includes the first lines 654 along the ribs and the second lines 656 along the direction X. The bus electrode further includes a plurality of extending electrodes 660 extending in direction Y. The extending electrodes 660 can be rectangular, protruding into the cross discharge space.

Referring to FIG. 15, the PDP having a resolution 1365*768 is given as an example of the third embodiment, the lateral pitch 662 size is about 540 μm and the vertical pitch 664 size is about 405 μm. The lateral line 666 of the cross is about 160 μm and the vertical line 668 of the cross is about 206 μm. Width of the rib is about 60 μm.

FOURTH EMBODIMENT

Figure 16:
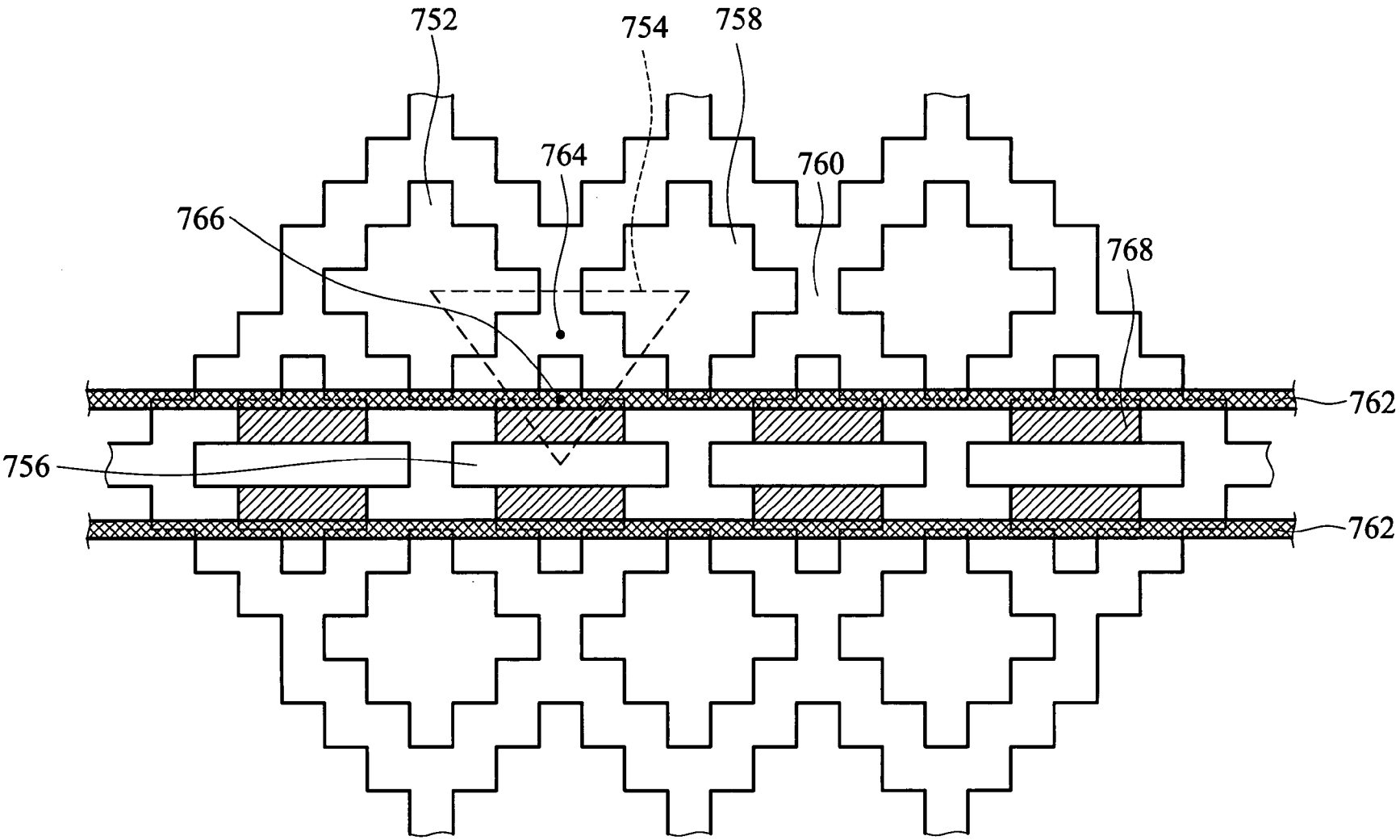
FIG. 16 is a top view of a PDP of the fourth embodiment.

FIG. 16 is a top view of the PDP of the fourth embodiment. As shown in FIG. 10, a plurality of ribs 760 are disposed on a rear substrate to form near cross discharge spaces 752 in a delta configuration 754. The near cross discharge spaces include a square as a main portion and four rectangular sub portions extending from each side of the main portion. Red near cross discharge space 752, green near cross discharge space 756 and blue near cross discharge space 758 are formed in a delta configuration. In the preferable embodiment, each rib 760 has two layers with different color. The top layer of the rib 760 is black to enhance contrast and the bottom layer is white to increase luminance. The preferable height of each rib 760 is 100 μm~180 μm.

A front substrate is disposed over a rear substrate. A plurality of bus electrodes 762 are disposed on the front substrate, extending in direction X and passing the top and the down regions of the corresponding near cross discharge space 752. Each bus electrode 762 can be arranged in parallel in a line shape. The bus electrodes 762 include a plurality of extending electrodes 768 extending in direction Y to protrude into a corresponding near cross sub-pixel. The extending electrodes 768 can be rectangular. The bus electrodes can be a multi-layer metal film, such as Cr/Cu/Cr, or Ag. The extending electrodes are preferably formed of transparent conductive material, such as ITO.

Consequently, The rib structure of the present invention forms close discharge spaces 752 with a longer axis in one direction which provides space for longer plasma extension and better discharge efficiency. Moreover, the close discharge space of the invention can eliminate crosstalk.

Figure 17:
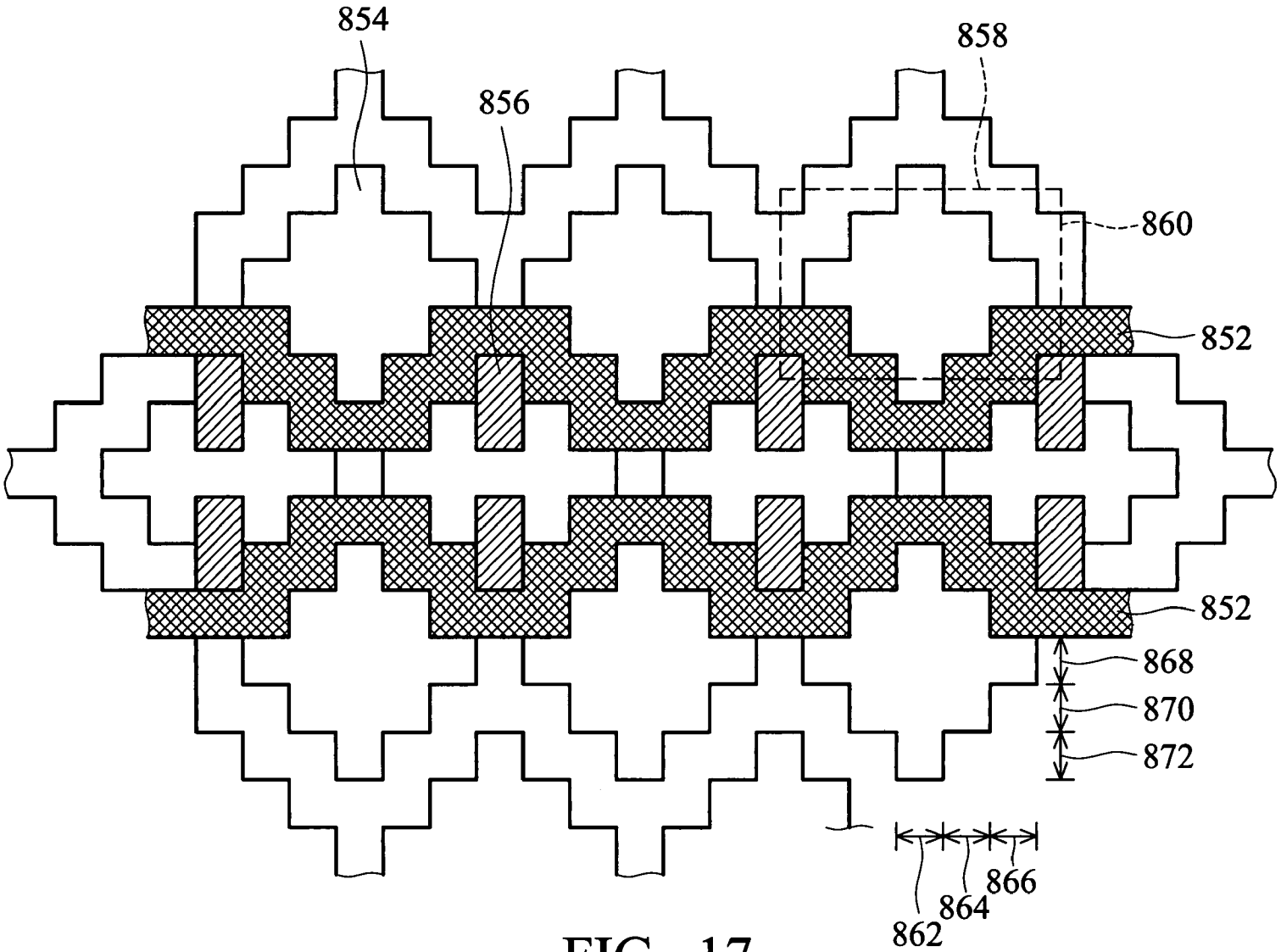
FIG. 17 is a top view of a PDP of another electrode structure of the fourth embodiment.

FIG. 17 illustrates another electrode structure of the fourth embodiment. Referring to FIG. 17, the bus electrodes 852 can be arranged in a zigzag shape extending along the ribs substantially in direction X. In addition, each bus electrode 852 includes a plurality of extending electrodes 856 extending in direction Y. The extending electrodes 856 can be rectangular, protruding into the corresponding near cross discharge space.

Referring to FIG. 17, the PDP having a resolution 1365*768 is given as an example of the fourth embodiment, the lateral pitch 858 size is about 540 μm and the vertical pitch 860 size is about 860 μm. Length of the first lateral side 862, second lateral side 864 and third lateral side 866 of the near cross are respectively 180 μm, 90 μm and 90 μm. In addition, length of the first vertical side 868, second vertical side 870 and third vertical side 872 of the near cross are respectively 202.5 μm, 101.25 μm and 101.25 μm. Width of the rib is about 60 μm.

According to the four the embodiment described above, the close discharge space can be non-equal hexagonal, diamond shape, cross, near cross or any other shape in which includes a first axis and a second axis, with the first axis being longer than the second axis. In addition, the bus electrodes can be lines or zigzag shapes along corresponding rip, and the extending electrodes can be square or near triangle or any other shape. Each non-equal hexagonal, diamond shape, cross or near cross sub-pixel of the present invention has one longer axis. Thus, the structures with close discharge space provided by the present invention can achieve better discharge efficiency.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of thee appended claims should be accorded the broadest interpretation so as to encompass all such modifications and similar arrangements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of thee appended claims should be accorded the broadest interpretation so as to encompass all such modifications and similar arrangements.

What is claimed is:

1. A structure of plasma display panel, comprising:

a rear substrate;

a plurality of ribs formed on the rear substrate to define a plurality of near cross discharge spaces, wherein each discharge space has a first axis along a first direction and a second axis along a second direction, the length of the first axis is longer than the length of the second axis;

a front substrate opposite the rear substrate; and a plurality of bus electrodes formed on the front substrate, each extending substantially in the second direction and containing a plurality of extending electrodes protruding to corresponding near cross discharge spaces.

2. The structure as claimed in claim 1, wherein the first direction and the second direction are perpendicular.

3. A structure of plasma display panel, comprising:

a rear substrate;

a plurality of ribs formed on the rear substrate to define a plurality of near cross discharge spaces;

a front substrate opposite the rear substrate; and a plurality of bus electrodes formed on the front substrate, each extending substantially in a first direction and containing a plurality of extending electrodes protruding to corresponding near cross discharge space.

4. The structure as claimed in claim 3, wherein the bus electrodes are line shape and parallel with each other or the bus electrodes are zigzag shaped extending along the ribs.

5. The structure as claimed in claim 3, wherein the near cross discharge spaces include a square as a main portion and four rectangular sub portions extending from each side of the main portion.

* * * * *